US012690663B2

(12) United States Patent
Optekar

(10) Patent No.: US 12,690,663 B2
(45) Date of Patent: Jul. 28, 2026

(54) DRINKING STRAW CLEANING DEVICE

(71) Applicant: David Optekar, Plantation, FL (US)

(72) Inventor: David Optekar, Plantation, FL (US)

( * ) Notice: Subject to any disclaimer, the term of this patent is extended or adjusted under 35 U.S.C. 154(b) by 244 days.

(21) Appl. No.: 17/855,689

(22) Filed: Jun. 30, 2022

(65) Prior Publication Data

US 2023/0000242 A1 Jan. 5, 2023

Related U.S. Application Data

(60) Provisional application No. 63/218,102, filed on Jul. 2, 2021.

(51) Int. Cl.

| | |
|---|---|
| ***A46B 13/04*** | (2006.01) |
| ***A46B 5/00*** | (2006.01) |
| ***A46B 9/02*** | (2006.01) |
| ***A46B 11/00*** | (2006.01) |
| ***A46B 13/00*** | (2006.01) |
| ***A47L 17/00*** | (2006.01) |

(52) U.S. Cl.

CPC ..... *A46B 13/04* (2013.01); *A46B 5/0062* (2013.01); *A46B 9/026* (2013.01); *A46B 11/0041* (2013.01); *A46B 13/001* (2013.01); *A47L 17/00* (2013.01); *A46B 2200/3013* (2013.01)

(58) Field of Classification Search

CPC ..... A46B 13/04; A46B 5/0062; A46B 5/00; A46B 9/026; A46B 9/005; A46B 9/02; A46B 11/0041; A46B 11/00; A46B 13/001; A46B 13/00; A46B 2200/3013; A46B 15/0097; A46B 17/00; A46B 3/18; A46B 17/02; A46B 9/021; A46B 2200/3073; A46B 13/02; A46B 7/04; A47L 17/00; A47L 25/00; B08B 9/04; B08B 9/00; B08B 9/027; B08B 1/12; B08B 9/023

See application file for complete search history.

(56) References Cited

U.S. PATENT DOCUMENTS

| | | | | |
|---|---|---|---|---|
| 1,436,361 | A * | 11/1922 | Seeley | A47L 15/0068 15/75 |
| 2,049,365 | A * | 7/1936 | Follett | A47L 15/0068 15/75 |
| 2,671,235 | A * | 3/1954 | Gochoel | A47L 15/0068 15/76 |
| 4,862,549 | A * | 9/1989 | Criswell | A46B 9/02 228/205 |
| 6,039,490 | A * | 3/2000 | Banks | A46B 9/02 15/406 |
| 11,020,779 | B1 * | 6/2021 | Chen | A47L 15/0068 |
| 2013/0174365 | A1 * | 7/2013 | Amicon | A47L 15/0068 15/176.3 |
| 2019/0351458 | A1 * | 11/2019 | Hawkins | A46B 13/02 |
| 2020/0001329 | A1 * | 1/2020 | Brennan | B08B 1/32 |
| 2021/0161356 | A1 * | 6/2021 | Luu | A46B 13/026 |

FOREIGN PATENT DOCUMENTS

| | | | | |
|---|---|---|---|---|
| GB | 2480225 | A * | 11/2011 | A46B 11/08 |

* cited by examiner

*Primary Examiner* — Monica S Carter
*Assistant Examiner* — Kent N Shum
(74) *Attorney, Agent, or Firm* — Tucker Law; Matthew Sean Tucker

(57) ABSTRACT

A straw cleaning device for cleaning drinking straws utilizing a motor for rotating a cleaning member for cleaning the inside and/or the outside of a drinking straw, the cleaning member optionally able to dispense cleaning solution about at least a portion of the drinking straw.

17 Claims, 3 Drawing Sheets

DRINKING STRAW CLEANING DEVICE

CROSS-REFERENCE TO RELATED APPLICATION

This application is related to and claims benefit to U.S. Provisional Patent Application Ser. No. 63/218,102, filed Jul. 2, 2021, entitled DRINKING STRAW CLEANING DEVICE, the entirety of which is incorporated herein by reference.

FIELD OF THE INVENTION

The present invention relates to a drinking straw device, and more particularly to a drinking straw device with an electric motor for cleaning reusable straws.

BACKGROUND OF THE INVENTION

Alternatives to plastic straws are becoming more prevalent in many communities to avoid the harms to the environment. Now, many homes and establishments are switching to paper or reusable straws in place of plastic as a greener alternative.

Conventional straw cleaners require the user to twist the element in order to clean the interior surface of the straw. However, this hand action is inferior to the cleaning provided by an electric motor and fail to thoroughly clean all of the interior surfaces of the reusable straws.

There is a need in the art for a straw cleaning device with an electric motor and increased cleaning ability.

SUMMARY OF THE INVENTION

The present invention advantageously provides a drinking straw device with an electric motor to clean the inside of a reusable straw.

According to an embodiment of the present invention, a principal object is to provide a straw cleaning device with a housing, the housing serves as a gripable portion for holding the straw cleaning device, the housing contains the electrical and mechanical components for cleaning a reusable straw.

According to yet another embodiment of the present invention, the housing includes an on/off switch for turning on the cleaning function of the straw cleaning device, with the switch in the on position causes the motor to drive a cleaning shaft in rotation about the length of the cleaning shaft that engages with a reusable straw for scrubbing the inside portion of a straw.

According to an embodiment of the present invention, another object is to provide a cleaning shaft with a plurality of apertures that are positioned along the cleaning shaft for dispensing a cleaning solution to the interior of the reusable straw, with a dispensement portion for injecting cleaning solution from a reservoir, through the shaft, and about a portion of the inside of a reusable straw.

According to one non-limiting embodiment of the present invention, another object is to provide a straw cleaning device with a cleaning member capable of cleaning at least a portion of the inside and outside of a straw simultaneously, with an internal shaft and an outer core which rotate via a motor for simultaneous cleaning of a reusable straw, and a plurality of internal shaft apertures for cleaning the inside portion of a reusable straw and/or a plurality of outer core apertures for cleaning the outside portion of a reusable straw.

According to one non-limiting embodiment of the present invention, another object is to provide a motorized straw cleaner having an enclosure with having a tubular shape extending at least partially along an axis, the enclosure having a first opening, and a straw cleaning member extending out a length at a proximal end of the straw cleaning member from the first opening, the straw cleaning member rotatable about the enclosure, and the straw cleaning member is configured to be inserted about a distal end of the straw cleaning member into a straw, and further includes an electric motor contained within the enclosure configured to rotate said straw cleaning member about said enclosure, an on/off switch is positioned about an outer surface of the enclosure, a battery is contained within the enclosure in electrical communication with the electric motor, a battery charger receiving portion positioned about the outer surface of the enclosure, the battery charger receiving portion configured to receive a charging cord, the straw cleaning member having said length between the proximal end and the distal end, and a plurality of straw cleaning bristles are disposed along the length of the straw cleaning member.

Other objects will become evident as the present invention is described in detail below.

BRIEF DESCRIPTION OF THE DRAWINGS

Embodiments of the present application are described herein in which similar elements are given similar reference characters, and a more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
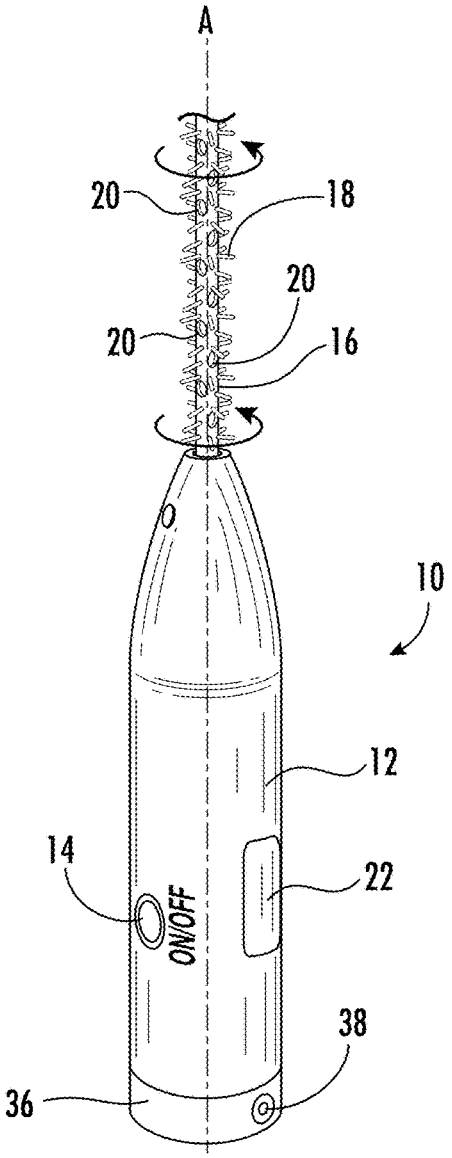
FIG. 1 is a perspective view of a straw cleaning device in accordance with the principles of the present embodiment.

The present invention advantageously provides a straw cleaning device for cleaning reusable straws. The present invention contemplates various types of straw cleaning device.

Accordingly, the device components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Referring now to the drawings figures in which like reference designators refer to like elements. FIG. 1 shows an exemplary straw cleaning device constructed in accordance with the principles of the present invention and designated generally as straw cleaning device "10." In particular, straw cleaning device 10 includes a housing 12. The housing 12 serves as a gripable portion for holding the straw cleaning device 10. The housing 12 contains the electrical and mechanical components for cleaning a reusable straw.

The housing 12 further includes an on/off switch 14 for turning on the cleaning function of the straw cleaning device 10. The switch 14 in the on position causes the motor to drive a cleaning shaft 16 in rotation about the length of the cleaning shaft 16.

The cleaning shaft 16 includes cleaning bristles 18 along at least a portion of the length of the cleaning shaft 16. The cleaning bristles 18 are positioned and formed to clean the interior of a reusable straw.

Figure 2:
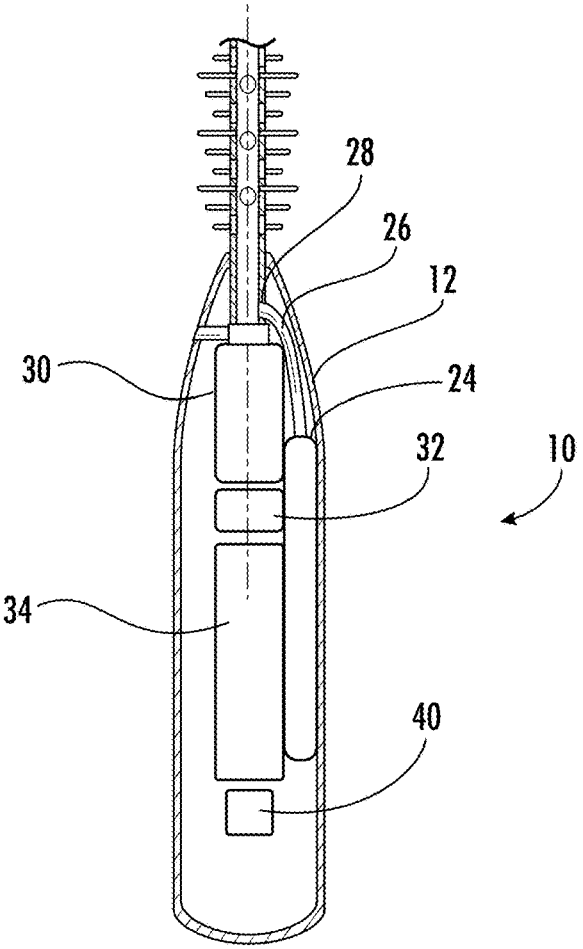
FIG. 2 is a cross-sectional via of FIG. 1 taken along line A-A.

Referring now to FIGS. 1-2, the cleaning shaft 16 includes a plurality of apertures 20 that are positioned along the cleaning shaft 16 for dispensing a cleaning solution to the interior of the reusable straw. The housing 12 includes a depressible member 22 for forcing cleaning solution from a reservoir 24.

In one non-limiting embodiment, depression of member 22 forces cleaning solution through the reservoir feed tube 26 and through one or more proximal openings 28 in the cleaning shaft 16.

Referring to FIG. 2, the housing 12 holds the electric motor 30 in driving relation to the cleaning shaft 16. The housing may further hold a controller unit 32 for controlling the electronics of the straw cleaning device. The housing 12 further holding a power member 34. In the instant embodiment, the power member 34 is a rechargeable battery.

In another non-limiting embodiment, the power member 34 is replaceable batteries, such as AAA or AA batteries and replaced via the bottom 36 of the housing 12 shown in FIG. 1.

In a non-limiting embodiment, the housing 12 further includes a charging port 38 that integrates with a charging portion 40 for recharging the power member 34.

Figure 3:
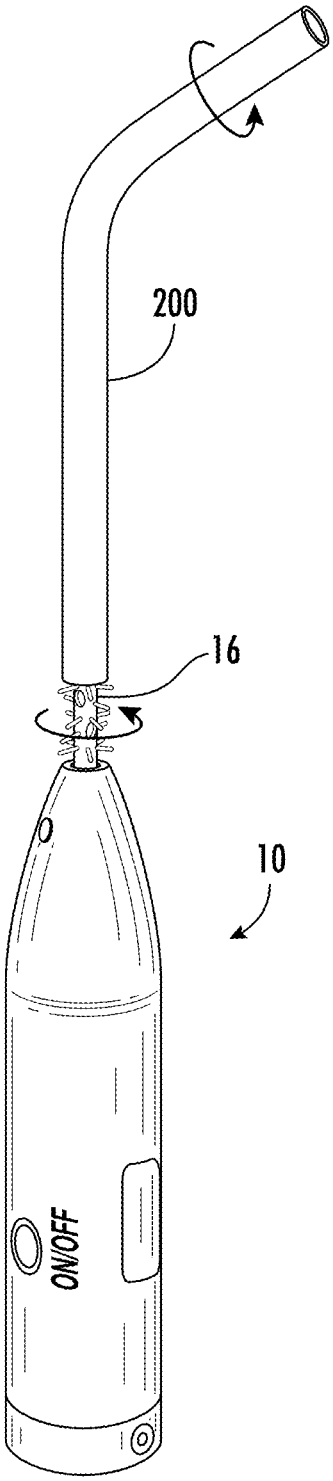
FIG. 3 is a perspective view of the straw cleaning device of FIG. 1 engaged with a reusable straw in accordance with the principles of the present embodiment.
Figure 4:
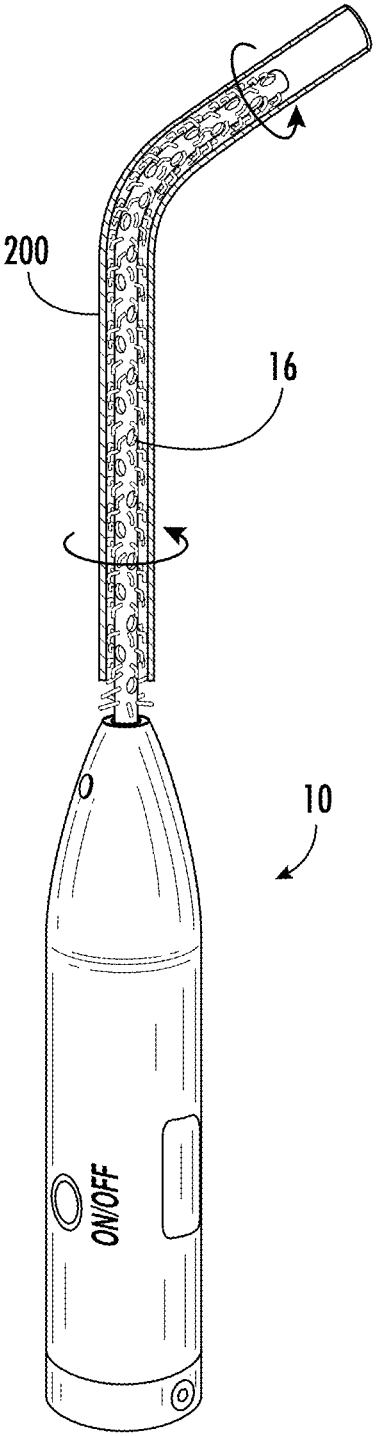
FIG. 4 is perspective view of the straw cleaning device of FIG. 3 with a cross-sectional view of the reusable straw displaying the flexible nature of the cleaning shaft in accordance with the principles of the present embodiment.

Referring now to FIGS. 3-4, straw cleaning device 10 includes the cleaning shaft 16 that is adaptable to the interior shape of the reusable straw 200.

Figure 5:
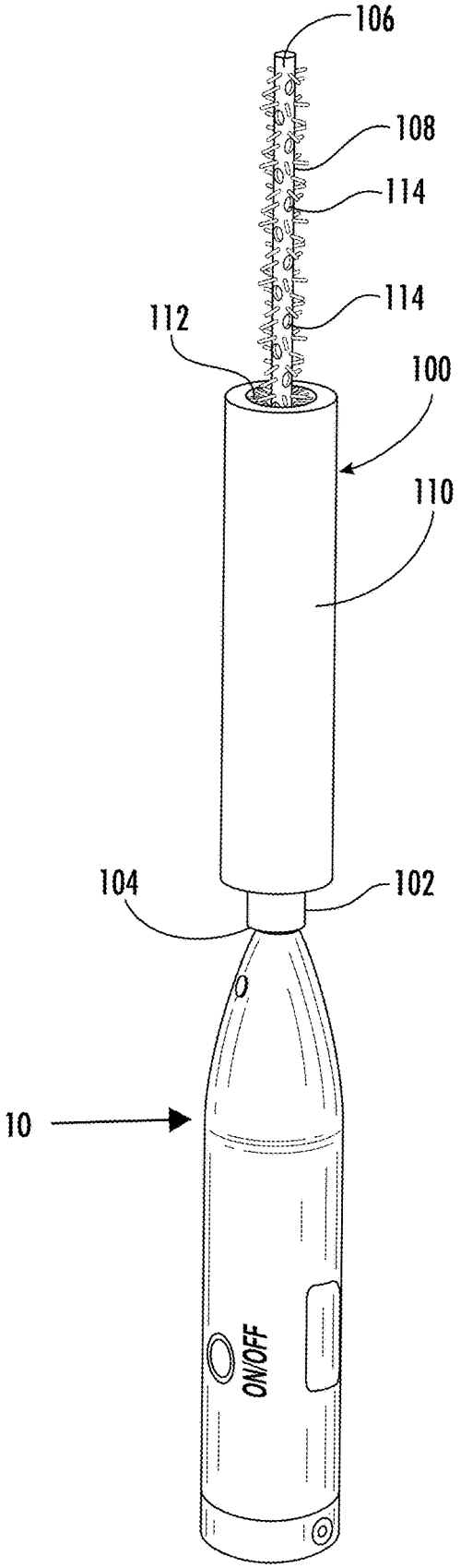
FIG. 5 is a perspective view of a straw cleaning device with a straw cleaning member for cleaning the inside and outside of a reusable straw in accordance with the principles of the present embodiment.
Figure 6:
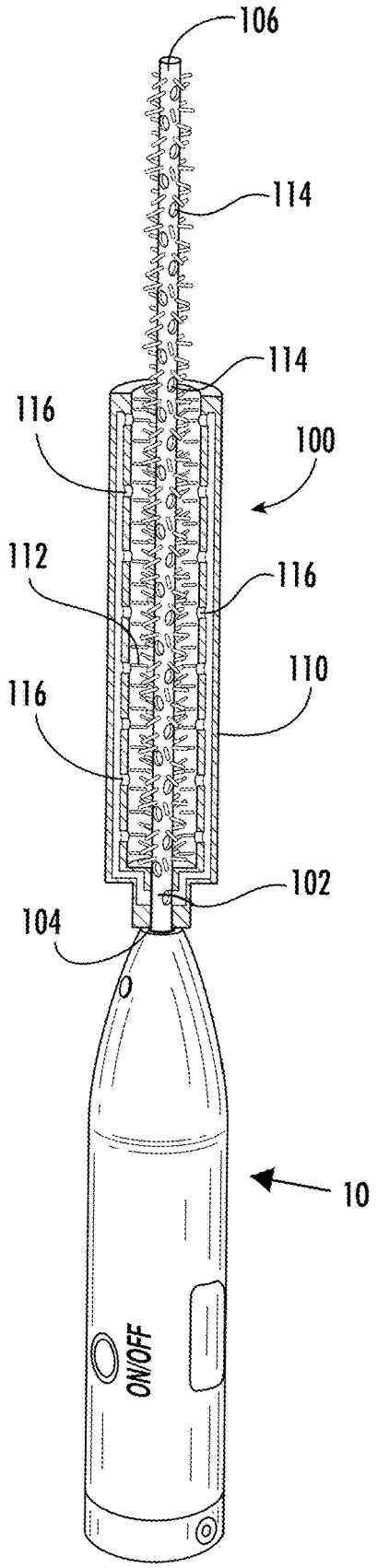
FIG. 6 is a perspective view of a strawing cleaning device of FIG. 5 with a cross-sectional view of the straw cleaning member in accordance with the principles of the present embodiment.

Referring now to FIGS. 5-6, straw cleaning device 10 includes an alternative cleaning member capable of cleaning at least a portion of the inside and outside of a straw simultaneously. In this alternative embodiment, a straw cleaning member 100 is provided with an internal shaft 102 extending from a first proximal end 104 to a distal end 106. The internal shaft 102 includes bristles 108 for cleaning the inside portion of a reusable straw. The straw cleaning member 100 includes an outer core 110 with internal bristles 112 for cleaning the outside portion of a reusable straw. The motor located in the housing 12 of the straw cleaning device causes the outer core 110 and the internal shaft 102 to rotate for simultaneous cleaning of a reusable straw. The depressible member 22 on the housing 12 when depressed causes cleaning solution to dispense from the plurality of internal shaft apertures 114 for cleaning the inside portion of a reusable straw and/or a plurality of outer core apertures 116 for cleaning the outside portion of a reusable straw.

In a non-limiting embodiment, the straw cleaning member 100 is non-rigid allowing the bristles to snake about the shape of the reusable straw.

In a non-limiting embodiment, the straw cleaning device 10 is capable of releasing and replacing the cleaning shaft 16 with a new cleaning shaft 16 and/or straw cleaning member 100 allowing a user to choose between an internal straw cleaner of cleaning shaft 16 versus an internal/external of straw cleaning member 100.

As used herein, when the term "and/or" is used, it shall include all combinations of one or more of the associated described items.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are contemplated in light of the above teachings without departing from the scope and spirit of the invention. It will be readily apparent that various changes may be made thereto without departing from the spirit and scope of the disclosure or sacrificing all of its material advantages. The examples and embodiments described herein are merely exemplary of the instant disclosure.

What is claimed is:

1. A motorized straw cleaner, comprising:

an enclosure having a first opening; and a straw cleaning member extending out a length from said first opening and rotatable about said enclosure, said straw cleaning member having a proximal end and a distal end, said straw cleaning member forming an interior straw cleaning portion and an exterior straw cleaning portion, said interior straw cleaning portion having first cleaning bristles capable of cleaning an interior wall of a straw, said exterior straw cleaning portion having second cleaning bristles capable of cleaning an exterior wall of the straw, said exterior straw cleaning portion is positioned at least partially around said interior straw cleaning portion;

wherein said interior straw cleaning portion is configured to be insertable, with said distal end of said straw cleaning member, into an interior of the straw such that said first cleaning bristles clean at least a portion of the interior wall of the straw while said exterior straw cleaning portion simultaneously engages at least part of the exterior wall of the straw during rotation such that said second cleaning bristles clean at least a portion of the exterior wall of the straw; and wherein a plurality of dispensing openings are spaced along said straw cleaning member and configured to dispense cleaning solution along a length of said straw cleaning member, wherein said plurality of dispensing openings comprises (i) a first plurality of dispensing openings spaced along said interior straw cleaning portion and (ii) a second plurality of dispensing openings spaced along said exterior straw cleaning portion, said second plurality of dispensing openings configured to dispense cleaning solution onto the exterior wall of the straw during rotation.

2. The motorized straw cleaner of claim 1, further comprising an electric motor contained within said enclosure, said electric motor configured to rotate said straw cleaning member about said enclosure.

3. The motorized straw cleaner of claim 2, further comprising an on/off switch positioned about an outer surface of said enclosure.

4. The motorized straw cleaner of claim 3, further comprising a battery contained within said enclosure in electrical communication with said electric motor.

5. The motorized straw cleaner of claim 1, wherein said straw cleaning member, having said length between said proximal end and said distal end, has a plurality of said first and second cleaning bristles disposed along said length.

6. The motorized straw cleaner of claim 5, wherein said first cleaning bristles extend out from said straw cleaning member circumferentially.

7. A motorized straw cleaner, comprising:

an enclosure having a tubular shape extending at least partially along an axis, said enclosure having a first opening;

a straw cleaning member extending out a length from said first opening, said straw cleaning member rotatable about said enclosure, said straw cleaning member forming an interior straw cleaning portion and an exterior straw cleaning portion;

an electric motor contained within said enclosure, said electric motor configured to rotate said straw cleaning member about said enclosure;

a cleaning solution reservoir contained within said enclosure, said cleaning solution reservoir in fluid communication with said straw cleaning member, said cleaning solution reservoir capable of delivering cleaning solution through said straw cleaning member; and a plurality of dispensing openings spaced along a length of said straw cleaning member, wherein said plurality of dispensing openings comprises (i) a first plurality of dispensing openings spaced along said interior straw cleaning portion configured to dispense cleaning solution onto an interior surface of a straw and (ii) a second plurality of dispensing openings spaced along said exterior straw cleaning portion configured to dispense cleaning solution onto an exterior surface of the straw during rotation.

8. The motorized straw cleaner of claim 7, further comprising an on/off switch positioned about an outer surface of said enclosure.

9. The motorized straw cleaner of claim 8, further comprising a battery contained within said enclosure in electrical communication with said electric motor.

10. The motorized straw cleaner of claim 9, further comprising a controller unit contained within said enclosure and configured to control operation of said electric motor.

11. The motorized straw cleaner of claim 7, wherein said straw cleaning member has a plurality of cleaning bristles.

12. The motorized straw cleaner of claim 11, wherein said cleaning solution reservoir is capable of delivering cleaning solution to said plurality of cleaning bristles.

13. A motorized straw cleaner, comprising:

an enclosure body, said enclosure having a first opening;

an electric motor contained within said enclosure body;

a cleaning solution reservoir contained within said enclosure body, said cleaning solution reservoir in fluid communication with said straw cleaning member;

a straw cleaning member extending out at a proximal end from said first opening, said straw cleaning member formed of a flexible elongated body capable of rotating inside a curved drinking straw, said straw cleaning member having a plurality of cleaning bristles extending outward along said elongated body, said straw cleaning member forming an interior straw cleaning portion and an exterior straw cleaning portion, said exterior straw cleaning portion positioned at least partially around said interior straw cleaning portion;

wherein said straw cleaning member is in mechanical communication with said electric motor, and said interior straw cleaning portion and said exterior straw cleaning portion are capable of being driven in rotation via said electric motor;

wherein said elongated body is insertable into an interior space of the drinking straw to clean at least a portion of an interior surface and an exterior surface of the drinking straw simultaneously via said rotation of said cleaning bristles; and wherein a plurality of dispensing openings are spaced along said straw cleaning member, wherein said plurality of dispensing openings comprises (i) a first plurality of dispensing openings spaced along said interior straw cleaning portion and (ii) a second plurality of dispensing openings spaced along said exterior straw cleaning portion, and wherein said cleaning solution reservoir is configured to deliver cleaning solution through said straw cleaning member to at least one of said first plurality of dispensing openings and said second plurality of dispensing openings.

14. The motorized straw cleaner of claim 13, wherein said straw cleaning member further includes an outer elongated core with a plurality of internal cleaning bristles extending inward from said outer elongated core, said outer elongated core slides over an outer body of the drinking straw to clean the outer body of the drinking straw via said rotation of said internal cleaning bristles.

15. The motorized straw cleaner of claim 14, wherein said elongated body and said outer elongated core rotate in unison via said electric motor.

16. The motorized straw cleaner of claim 14, further comprising a depressible member positioned about an outer surface of said enclosure body and operatively coupled to said cleaning solution reservoir, said depressible member configured, when depressed, to dispense cleaning solution from said cleaning solution reservoir through said straw cleaning member and out of at least one of said first plurality of dispensing openings and said second plurality of dispensing openings during rotation.

17. The motorized straw cleaner of claim 13, further comprising a battery contained within said enclosure body in electrical communication with said electric motor.

* * * * *